US008844477B2

(12) United States Patent
Stark et al.

(10) Patent No.: US 8,844,477 B2
(45) Date of Patent: Sep. 30, 2014

(54) HAND-HELD WORK APPARATUS POWERED BY INTERNAL COMBUSTION ENGINE

(75) Inventors: Stefan Stark, Huskvarna (SE); Joakim Arvby, Jönköping (SE); Stefan Steen, Huskvarna (SE); Annica Gabrielsson, Huskvarna (SE)

(73) Assignee: Husqvarna AB, Huskvarna (SE)

( * ) Notice: Subject to any disclaimer, the term of this patent is extended or adjusted under 35 U.S.C. 154(b) by 54 days.

(21) Appl. No.: 13/512,159

(22) PCT Filed: May 21, 2010

(86) PCT No.: PCT/SE2010/050552

§ 371 (c)(1),
(2), (4) Date: May 25, 2012

(87) PCT Pub. No.: WO2011/068453

PCT Pub. Date: Jun. 9, 2011

(65) Prior Publication Data

US 2012/0285410 A1 Nov. 15, 2012

(30) Foreign Application Priority Data

Dec. 2, 2009 (WO) ..... PCT/SE2009/051367

(51) Int. Cl.

| | |
|---|---|
| ***F01P 7/04*** | (2006.01) |
| ***F01P 1/00*** | (2006.01) |
| ***F01P 1/02*** | (2006.01) |
| ***F02M 35/024*** | (2006.01) |
| ***F02M 35/022*** | (2006.01) |
| ***F02M 35/10*** | (2006.01) |
| ***F02M 35/06*** | (2006.01) |
| *F02B 63/02* | (2006.01) |

(52) U.S. Cl.

CPC ..... *F02M 35/06* (2013.01); *F02M 35/024* (2013.01); *F02M 35/0226* (2013.01); *F02M 35/1017* (2013.01); *F02B 63/02* (2013.01)

USPC ..... 123/41.65; 123/41.7; 123/41.56; 123/41.63

(58) Field of Classification Search

USPC ..... 123/41.65, 41.7, 41.56, 41.63, 184.21

See application file for complete search history.

(56) References Cited

U.S. PATENT DOCUMENTS 5,231,956 A * 8/1993 Lux et al. ..... 123/41.65
5,269,265 A * 12/1993 Pretzsch et al. ..... 123/41.56

(Continued)

FOREIGN PATENT DOCUMENTS

JP 2007113443 A 5/2007
WO 2006006894 A1 1/2006

OTHER PUBLICATIONS

International Search Report and Written Opinion of PCT/SE2009/051367 mailed May 10, 2010.

(Continued)

*Primary Examiner* — Lindsay Low
*Assistant Examiner* — Tea Holbrook
(74) *Attorney, Agent, or Firm* — Nelson Mullins Riley & Scarborough LLP

(57) ABSTRACT

A hand-held work apparatus includes an engine housing (200). An internal combustion engine (202) is arranged in the engine housing (200) and includes a cylinder (204) and a crankshaft. A fan wheel (214) is driven directly or indirectly by the crank shaft, such that the fan wheel (214) rotates about an axis A. A fan housing (216) surrounds and cooperates with the fan wheel (214). A combustion air inlet (224) is located radially outside of the fan wheel (214) for leading air to the internal combustion engine (202). Further, the combustion air inlet (224) includes a combustion air inlet port (226) and a combustion air duct (228). The combustion air inlet port (226) is provided with a first edge (230), which first edge (230) is located radially adjacent to the periphery (220) of the fan wheel (214). An angle X between a first line L1 extending radially from the axis A in a direction parallel to a main direction of the cylinder (204) and a radius L2 extending radially from the axis A in a direction such that it intersects with the first edge (230), is less than 70° and preferably less than 66°, and even more preferably less than 62°.

17 Claims, 5 Drawing Sheets

(56) References Cited

U.S. PATENT DOCUMENTS

| | | | | |
|---|---|---|---|---|
| 5,363,815 | A * | 11/1994 | Pretzsch et al. | 123/41.7 |
| 5,377,632 | A * | 1/1995 | Aronsson et al. | 123/198 E |
| 5,533,869 | A * | 7/1996 | Garrison et al. | 417/234 |
| 5,542,380 | A * | 8/1996 | Chatten | 123/41.7 |
| 5,720,243 | A * | 2/1998 | Stegemyr et al. | 123/198 E |
| 6,295,953 | B1 * | 10/2001 | Ohsawa et al. | 123/41.7 |
| 6,314,922 | B1 * | 11/2001 | Zimmermann et al. | 123/41.65 |
| 6,378,467 | B1 * | 4/2002 | Kobayashi et al. | 123/41.56 |
| 6,494,180 | B1 * | 12/2002 | Schlossarczyk | 123/392 |
| 6,807,954 | B2 * | 10/2004 | Nara et al. | 123/556 |
| 6,868,821 | B2 * | 3/2005 | Maier et al. | 123/198 E |
| 6,880,515 | B2 * | 4/2005 | Geyer et al. | 123/198 E |
| 8,413,616 | B2 * | 4/2013 | Bergquist | 123/41.65 |
| 8,490,585 | B2 * | 7/2013 | Kienzle et al. | 123/41.58 |
| 2001/0029908 | A1 * | 10/2001 | Suzuki | 123/41.31 |
| 2007/0215090 | A1 * | 9/2007 | Gunnarsson et al. | 123/184.46 |
| 2008/0092840 | A1 * | 4/2008 | Yuasa | 123/179.11 |

OTHER PUBLICATIONS

Chapter I International Preliminary Report on Patentability of PCT/SE2009/051367 mailed Jun. 5, 2012.

International Search Report and Written Opinion of PCT/SE2010/050552 mailed Jan. 21, 2011.

Chapter I International Preliminary Report on Patentability of PCT/SE2010/050552 mailed Jun. 5, 2012.

* cited by examiner

HAND-HELD WORK APPARATUS POWERED BY INTERNAL COMBUSTION ENGINE

TECHNICAL FIELD

The present invention relates to a hand-held work apparatus such as, but not limited to, a chainsaw, a power cutter or a trimmer, which work apparatus is powered by an internal combustion engine. In particular, the present invention relates to cooling of such internal combustion engine. Also, the present invention relates to an air purification system for such internal combustion engine.

BACKGROUND OF THE INVENTION

Portable hand-held work apparatuses powered by internal combustion engines are well known in the art. When designing such apparatus, a high power-to-weight ratio is an important target. A limiting factor for increasing said ratio is the cooling capacity, which therefore needs to be improved.

Typically, the internal combustion engine is accommodated in an engine housing of the work apparatus and a crankshaft of the internal combustion engine is connected to a working tool via a suitable transmission mechanism. Further, the internal combustion engine directly or indirectly drives a fan wheel of a radial fan, which radial fan provides cooling of the internal combustion engine, especially by exposing cooling flanges of a cylinder of the internal combustion engine to a flow of cooling air. Typically, the fan wheel cooperates with a spirally-shaped fan housing surrounding the fan wheel. The fan wheel is mounted directly or indirectly to the crankshaft of the internal combustion engine and preferably, the fan wheel rotates at the same speed as the crankshaft. The fan wheel is configured to draw in air through its centre and blow air radially outwardly with the use of centrifugation.

Preferably, a combustion air inlet is located radially adjacent to the fan wheel and is used for leading combustion air to the internal combustion engine. Before reaching the internal combustion engine the combustion air flow passes an air filter. The position of the combustion air inlet radially adjacent to the fan wheel enables taking advantage of the centrifugal force acting on particles, e.g. dust particles, in the air flow, such that a purified air flow enters the combustion air inlet. Such use of centrifugation is often referred to as centrifugal purification. A purified combustion air flow reduces the risk of clogging of the air filter and can prolong service intervals. Clogging of the air filter is especially a problem in dusty environments. The air flow that does not enter the combustion air inlet is preferably used for cooling of the internal combustion engine, and especially for cooling the cylinder of the internal combustion engine. However, a problem with the described position of the combustion air inlet is that it is in the way of the flow of cooling air and, therefore, cooling capacity may be reduced.

Furthermore, a deflector can be provided downstream of the combustion air inlet and in close proximity to the periphery of the fan wheel. The deflector extends radially outwardly in relation to the fan wheel and ensures that the air flow is directed away from the fan wheel. This prevents air and particles from continuing to circulate with the fan wheel. Having air and particles staying in the radial fan will reduce cooling capacity, since the fan will then not be able to draw in as much air as desired. However, the deflector adds complexity to an overall construction of the radial fan and the work apparatus.

SUMMARY OF THE INVENTION

It is a first object of the present invention to provide an efficient cooling and a sufficient air purification system for an internal combustion engine of a hand-held work apparatus. It is another object of the present invention to provide an efficient cooling and a sufficient air purification system for an internal combustion engine of a hand-held work apparatus with a simple design with a small number of components.

The hand-held work apparatus includes an engine housing and an internal combustion engine arranged in the engine housing. The internal combustion engine includes a cylinder and a crankshaft, A fan wheel is directly or indirectly driven by the crankshaft such that the fan wheel rotates about an axis A. Further, a fan housing is provided to surround the fan wheel and cooperate with the fan wheel to supply combustion air and/or cooling air to the engine. Moreover, a combustion air inlet is located radially outside of the fan wheel for leading air to the internal combustion engine. Further, the combustion air inlet includes a combustion air inlet port and a combustion air duct. The combustion air inlet port is provided with a first edge which is located radially adjacent to the periphery of the fan wheel.

At least the first object is achieved with the hand-held work apparatus described in the latter paragraph and in claim 1, wherein an angle X between a first line L1 extending radially from the axis A in a direction parallel to a main direction of the cylinder and a radius L2 extending radially from the axis A in a direction such that it intersects with the first edge, is less than 70° and preferably less than 66° and even more preferably less than 62°, wherein L1 and L2 are seen from a side view. The above values of the angle X imply that the disturbance of the flow of cooling air is reduced as compared to prior art solutions, and still a sufficient purification and supply of combustion air can be reatained. Reducing the disturbance of the cooling air flow implies improved cooling capacity.

According to claims 2 and 3, the angle X is less than 58° and preferably less than 54°, and even more preferably less than 50°. Further, the angle X is less than 46° and preferably less than 42°, and even more preferably less than 38°. These conditions even more imply less disturbance of the flow of cooling air and have proved to still ensure a sufficient purific at ion and supply of combustion air.

According to claim 4, a deflector is provided radially outside and in close proximity to the periphery of the fan wheel to direct the flow of air blown out of the fan wheel away from the fan wheel. The deflector at least prevents the air from continuing to circulate with the fan wheel. This ensures that cooling capacity can be retained. Also, the deflector can be designed to direct cooling air towards areas where it is most needed, such as towards the cylinder or the muffler.

According to claim 5, the combustion air inlet and the deflector forms one single unit. This unit enables separation of the air flow such that a flow with low particle density may be conducted into the combustion air inlet port and a flow with higher particle may be used to cool the cylinder and/or other parts of the engine. By making the combustion air inlet and the deflector as one single unit, the number of parts in the fan housing is reduced. This implies that the weight of the whole product may be reduced and a simpler design may be possible. A reduced number of parts will simplify the manufacturing process and probably shorten the assembly time. Also, this solution implies generation of less noise as compared to prior art solutions, since only one edge instead of two will be disposed adjacent to the fan wheel. Thus, a fin of the fan wheel will pass only one edge per revolution of the fan wheel. The prior art solutions provide two separate edges, a combustion air inlet edge and a deflector edge, which means a fin of the fan wheel will pass two edges per revolution.

According to claim 6, an additional fan housing cover forms apart of the fan housing, such that at least a part of the combustion air inlet also forms one unit with the fan housing cover. This also reduces the number of parts and simplifies the manufacturing process and probably shortens assembly time. Of course, this also simplifies disassemble of the radial fan.

Further, according to claim 7, the combustion engine includes a crankcase such that a part of the combustion air inlet is formed in said crankcase. According to claim 8, the fan housing cover and the combustion air inlet are made of a plastic material and the combustion air inlet is formed by joining at least two parts by welding or gluing.

Moreover, according to claims 9 and 10, the combustion air inlet port also includes a second edge, which is disposed downstream and radially outside of the first edge in relation to the fan wheel. The second edge is disposed on the same side as the fan wheel with respect to a tangent T defined as a tangent to the radially outer periphery of the fan wheel which intersects with the first edge. Such location of the second edge is advantageous for preventing dust particles or other particles from entering the combustion air inlet and still enable enough air pressure in the combustion air inlet such that enough air can be supplied to the internal combustion engine. Further, at least some of the fins of the fan wheel each has an outer edge at the periphery of the fan wheel, such that at least one of the first and the second edges deviate at least 5° and preferably at least 10°, and even more preferably at least 15° from being parallel to the outer edge of at least one of the fins. Such configurations even more reduces the noise generated in the radial fan.

According to claim 11, the engine is provided with a muffler with a muffler housing. The muffler housing encloses the muffler and a portion of the muffler housing also forms a part of the fan housing. This ensures efficient cooling of the muffler and enables weight savings, a simple design, a simplified manufacturing process and shortened assembly time.

According to claim 12, a shield portion is provided in the close proximity to the combustion air inlet port. The shield portion extends an angular distance of at least 5° and preferably at least 10°, and even more preferably at least 15° in relation to axis A. With this configuration the shield portion prevents particles from bouncing against the cylinder or against other parts within the fan housing, such as the muffler, and then into the combustion air inlet. This improves the purification of the combustion air. Not having the shield portion implies that already centrifugally separated particles that have changed direction due to collisions with various parts may enter the combustion air inlet and subsequently end up clogging the air filter. The advantages of the shield portion are also apparent for angular distances of at least 20°, 25° or 30°. The shield portion is preferably flat, but the form can of course vary.

According to claim 13, at least one portion of the shield portion deviates from a plane surface. This has proved very favourable for preventing bouncing particles from entering the combustion air inlet. Also, the shield portion can be formed such that it may guide an air flow.

According to claim 14, the shield portion also forms one unit with the combustion air inlet. Further, according to claim 15, the hand-held work apparatus is a chainsaw with a lying cylinder configuration. The deflector/combustion air inlet as one unit in combination with the lying cylinder configuration has proved favourable in terms of efficient cooling of the cylinder and the exhaust port of the muffler.

According to claim 17 a hand-held work apparatus comprises an engine housing, and an internal combustion engine is arranged in the engine housing. The internal combustion engine comprises a cylinder and a crankshaft. A fan wheel is driven by the crankshaft, such that the fan wheel rotates about an axis A. A fan housing surrounds and cooperates with the fan wheel. A combustion air inlet is located radially outside and in close proximity to the periphery of the fan wheel for leading air to the internal combustion engine. The combustion air inlet comprises a combustion air inlet port and a combustion air duct. A deflector is located radially outside and in close proximity to the periphery of the fan wheel which deflector directs the flow of air and particles blown out of the fan wheel outwardly, so as to at least prevent the air and particles from continuing to circulate with the fan wheel, wherein the combustion air inlet forms one single unit with the deflector, which unit enables separation of the air flow such that a flow with low particle density may be conducted into the combustion air inlet and a flow with higher particle density may be used to cool the cylinder of the internal combustion engine. The above configuration not only provides for an efficient cooling and a sufficient air purification system, but also a simple design with a small number of components. Reducing the number of components implies that the weight of the whole product may be reduced. This is of course very advantageous for portable hand-held work apparatuses as they are carried by the operator and need to be versatile. A small number of components implies a simplified manufacturing process.

According to claim 19, a hand-held work apparatus comprises an engine housing. An internal combustion engine is arranged in the engine housing, and the internal combustion engine comprises a cylinder and a crankshaft. A fan wheel is driven directly or indirectly by the crank shaft, such that the fan wheel rotates about an axis A. A fan housing surrounds and cooperates with the fan wheel. A combustion air inlet is located radially outside of the fan wheel for leading combustion air to the internal combustion engine. The combustion air inlet comprises a combustion air inlet port and a combustion air duct. The combustion air inlet port is provided with a first edge, which first edge is located radially adjacent to the periphery of the fan wheel and the first edge is disposed at a radial distance d1 from the axis A along a radius L2 extending in a radial direction of the fan wheel and intersecting with the axis A and the first edge, wherein a distance d2 between the first edge and the fan housing along the radius L2 is at least 0.65 d1 and preferably at least 0.7 d1, and even more preferably at least 0.75 d1. These conditions for d2 imply that the flow of cooling air will not be very much disturbed by the combustion air inlet, since the cross-sectional area of the flow of cooling air is not very much reduced by the presence of the combustion air inlet. This enables a good cooling capacity. Greater values of d2, such as at least 0.8 d1, 0.85 d1 or 0.9 d1, are even more beneficial to the cooling capacity.

Further advantages with the present invention will be apparent from the detailed description.

DESCRIPTION OF THE DRAWINGS

In the following description of a preferred embodiment, reference will be made to the accompanying drawings, in which.

DETAILED DESCRIPTION OF PREFERRED EMBODIMENTS

Figure 1:
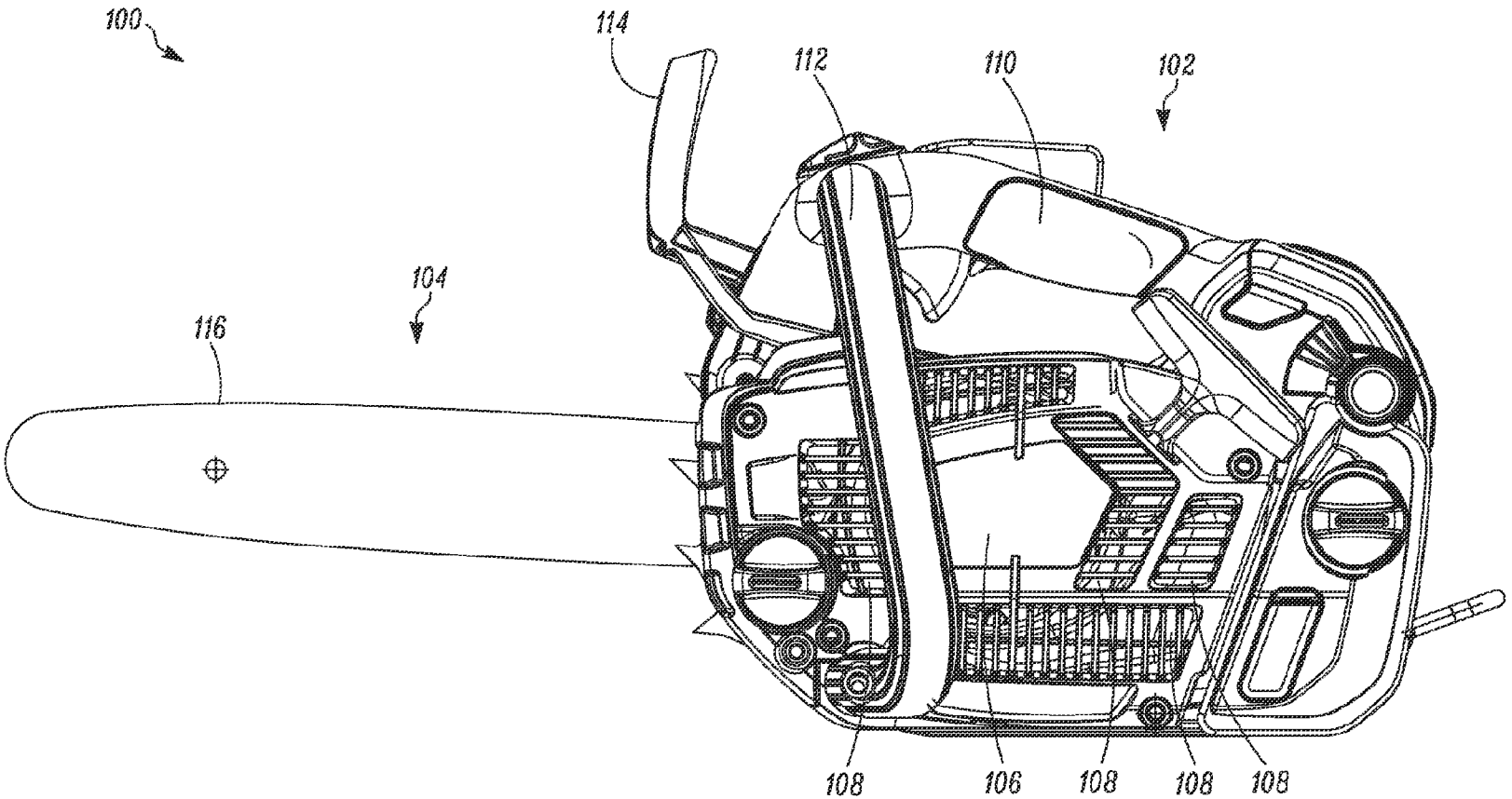
FIG. 1 illustrates a chainsaw, according to an example embodiment of the presort invention.

The present invention will be described more fully hereinafter with reference to the accompanying drawings, in which example embodiments of the invention incorporating one or more aspects of the present invention are shown. This invention can, however, be embodied in many different forms and should not be construed as limited to the embodiments set forth herein; rather, these embodiments are provided so that this disclosure will be thorough and complete, and will fully convey the scope of the invention to those skilled in the art. For example, one or more aspects of the present invention can be utilized in other embodiments and even other types of devices. In the drawings, like numbers refer to like elements.

FIG. 1 illustrates a chainsaw 100, according to an example embodiment of the present invention. Although, the exemplary embodiment illustrated in FIG. 1 is the chainsaw 100, it should be understood to a person skilled in art, that the present invention may be incorporated in any suitable type of portable hand-held working apparatus and is not limited for use in the chainsaw 100 only. Further, the present invention can be incorporated in different types of embodiments in various types of hand-held working apparatus, which can include brush-cutters, rotary saws, suction/blower apparatus, or the like.

As illustrated in FIG. 1, the chainsaw 100 includes a body 102 and a working implement 104. The body 102 includes an engine housing which encloses an internal combustion engine (hereinafter referred to as 'the engine') and a transmission assembly. In various other embodiments of the present invention, the engine can be a two-stroke internal combustion engine or a four-stroke internal combustion engine. Further, the engine housing can have a modular or integral construction without deviating from the scope of the present invention. In an embodiment of the present invention, the body 102 can further include a side cover 106. In an embodiment of the present invention, the side cover 106 is a separate component attached to the engine housing. In another embodiment of the present invention, the side cover 106 is integrally formed with the engine housing. Further, the side cover 106 includes multiple air intake openings 108 to permit an intake of ambient air to various components of the engine.

Moreover, the body 102 also includes atop handle 110 and a side handle 112. However, other types of handle configurations, for example, a rear handle configuration can be possible. At least one of the top handle 110 and the side handle 112 can include grip portions to aid in manual handling of the chainsaw 100. Additionally, a guard 114 can be provided to safeguard a user against the fast moving working implement 104 during a cutting operation.

As illustrated in FIG. 1, according to an embodiment of the present invention, the working implement 104 includes a guide bar 116. A chain (not shown) is supported on a peripheral guiding slot of the guide bar 116, which guiding slot can be continuous or not continuous. During operation, the engine drives the chain via the transmission assembly. In various embodiments of the present invention, the transmission assembly can include at least one of the for example, but not limiting to, one or more gears, one or more frictional members, one or more belt drives, or a combination of any of these.

Figure 2A:
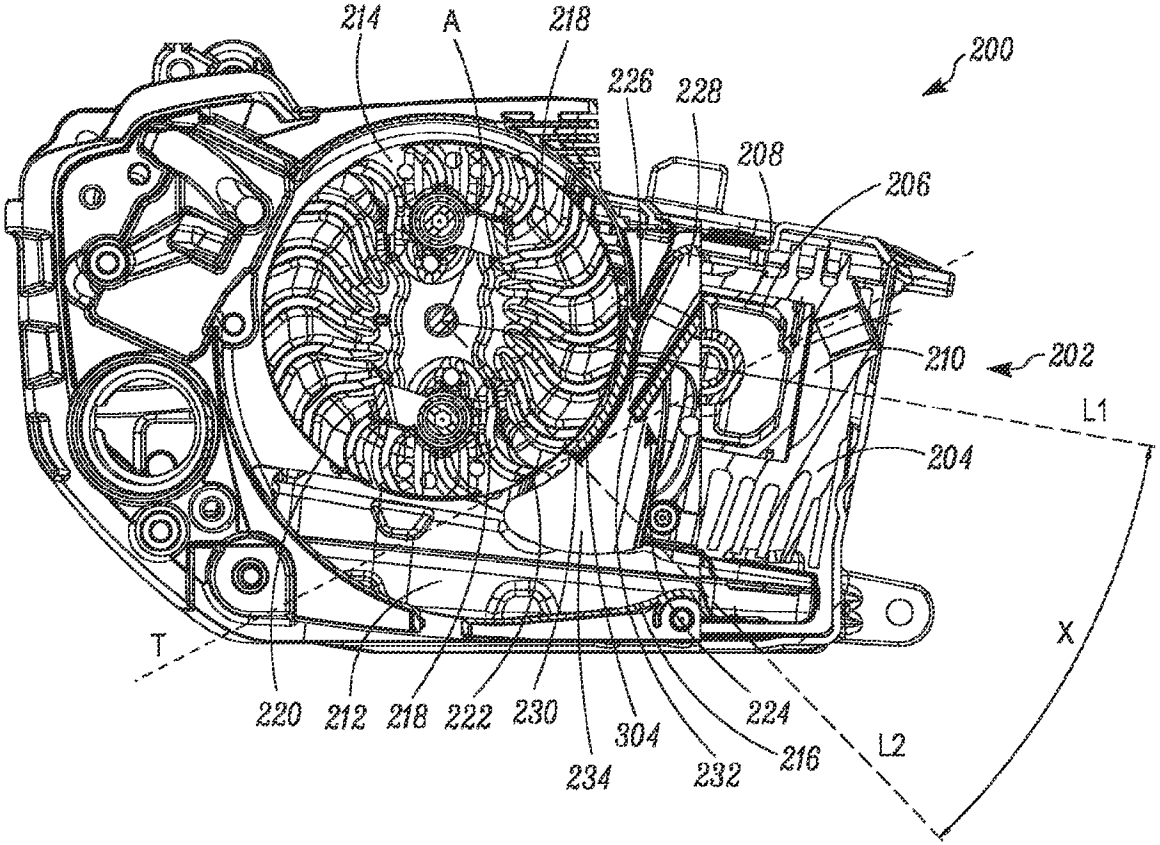
FIG. 2A illustrates a partial side view of an engine housing of the chainsaw, according to an embodiment of the present invention.

FIG. 2A illustrates a partial side view of an engine housing 200 of the chainsaw 100, according to an embodiment of the present invention. Various components of the chainsaw 100, including the side cover 106, are not shown in FIG. 2A for illustrative purposes. The engine housing 200 encloses the engine 202. Further, the engine 202 includes a cylinder 204 and a crankcase 205. However, the engine 202 may include two or more cylinders without deviating from the essence of the present invention. As illustrated in FIG. 2A, a main direction of the cylinder 204 is oriented in a substantially horizontal direction (hereinafter referred to as a lying cylinder configuration) within the engine housing 200. However, various other orientations of the cylinder 204 are possible within the scope of the present invention. The cylinder 204 includes a cylinder bore 206 in which a piston 208 reciprocates. Further, combustion of air and fuel mixture in a combustion chamber 210 drives the piston 208. The piston 208 is connected to a crankshaft (not shown) via a connecting rod (not shown). Subsequent to ignition of air and fuel mixture, exhaust gases exits the cylinder 204 and passes through an exhaust passage of the engine 202. In an embodiment of the present invention, a muffler housing 212 is provided around the exhaust passage to substantially reduce noise generated by the exhaust gases.

In an embodiment of the present invention, a fan wheel 214 is arranged inside a fan housing 216. In an embodiment of the present invention, the fan wheel 214 is a radial fan wheel. The fan wheel 214 is configured to supply both combustion air to the engine 202 and cooling air to various components of the engine 202, for example, but not limited to, the cylinder 204 and the muffler housing 212. The fan wheel 214 is configured to rotate substantially about an axis A. Further, the fan housing 216 is substantially spiral shaped to aid in the operation of the fan wheel 214. In an embodiment of the present invention, the fan housing 216 is a separate component attached to the engine housing 200. In another embodiment of the present invention, the fan housing 216 is integrally formed with the engine housing 200. In an embodiment of the present invention, at least a portion of the muffler housing 212 forms part of the fan housing 216.

According to an embodiment of the present invention, the fan wheel 214 is mounted directly on the crankshaft such that a rotational speed of the fan wheel 214 may be substantially equal to a rotational speed of the crankshaft. However, in various other embodiments of the present invention, the fan wheel 214 is indirectly driven by the crankshaft via one or more intermediate components, for example, but not limited to, one or more gears, friction drive, belt drive, or a combination of these. In such case, a rotational speed of the fan wheel 214 is substantially equal to or different from a rotational speed of the crankshaft. In an embodiment of the present invention, the fan wheel 214 includes multiple fins 218. As illustrated in FIG. 2A, the fins 218 are substantially S-shaped and each of the fins 218 extends to a radially outer periphery 220 (hereinafter referred to as 'the periphery 220') of the fan wheel 214. Possibly, not all fins extend to the outer periphery 220. At least some of the fins 218 each include an outer edge 222 adjacent to the periphery 220 of the fan wheel 214. It is apparent to a person ordinarily skilled in the art that any other shape, number and configuration of fins 218 is possible without deviating from the essence of the present invention.

In an embodiment of the present invention, a combustion air inlet 224 is located radially outside the fan wheel 214. The combustion air inlet 224 includes a combustion air inlet port 226 and a combustion air duct 228 to supply combustion air to the engine 202. One or more filter members and/or chambers (not shown) is provided between the combustion air inlet 224 and the engine 202. Further, in an embodiment of the present invention, the combustion air inlet 224 is connected to the crankcase of the engine 202 to supply combustion air into the crankcase.

According to an embodiment of the present invention, the combustion air inlet port 226 includes a first edge 230 and a second edge 232. The first edge 230 is located adjacent to the periphery 220 of the fan wheel 214. Further, the second edge 232 is located downstream and radially outwardly of the first edge 230 with respect to the periphery 220 of the fan wheel 214. The first—230 and the second edge 232 are or are not parallel. Of course, the combustion air inlet port 226 can have other shapes, such as, but not limited to, circular or elliptical. Preferably, the first edge 234 is straight, but it can have various shapes, such as a curved shape. It might even be serrated. The position of said first edge 230 is best illustrated in a cross-sectional side view perpendicular to the axis A, such as in FIG. 2A.

As illustrated in FIG. 2A, a first line L1 extends radially from the axis A in a direction substantially parallel to the main direction of the cylinder 204. Further, a radius L2 extends radially from the axis A such that the radius L2 intersects the first edge 230 of the combustion air inlet port 226, which first edge 230 is seen from a cross-sectional side view, as in FIG. 2A. In an embodiment of the present invention, an angle X between the first line L1 and the radius L2 is less than about 70°, preferably less than about 66°, and even more preferably less than about 62°, wherein X is seen from said cross-sectional side view, in another embodiment of the present invention, the angle X is less than about 58°, preferably less than about 54°, and even more preferably less than about 50°. In yet another embodiment of the present invention, the angle X is less than about 46°, preferably less than about 42°, and even more preferably less than about 38°. Such configurations ensure that flow of cooling air is not very much disturbed by the combustion air inlet.

Further, as illustrated in FIG. 2A, a tangent T is defined as the tangent line to the periphery 220 of the fan wheel 214 which intersects with the first edge 230. In an embodiment of the present invention, the second edge 232 is disposed on a same side as the fan wheel 214 with respect to the tangent T. This configuration has proved very beneficial in terms of purification of the combustion air. Moreover, according to an embodiment of the present invention, the first edge 230 deviates at an angle of at least about 5°, preferably at least about 10°, and even more preferably at least about 15° from being parallel to the outer edge 222 of at least one of the fins 218. This leads to reduction of noise generated in the radial fan.

Figure 2B:
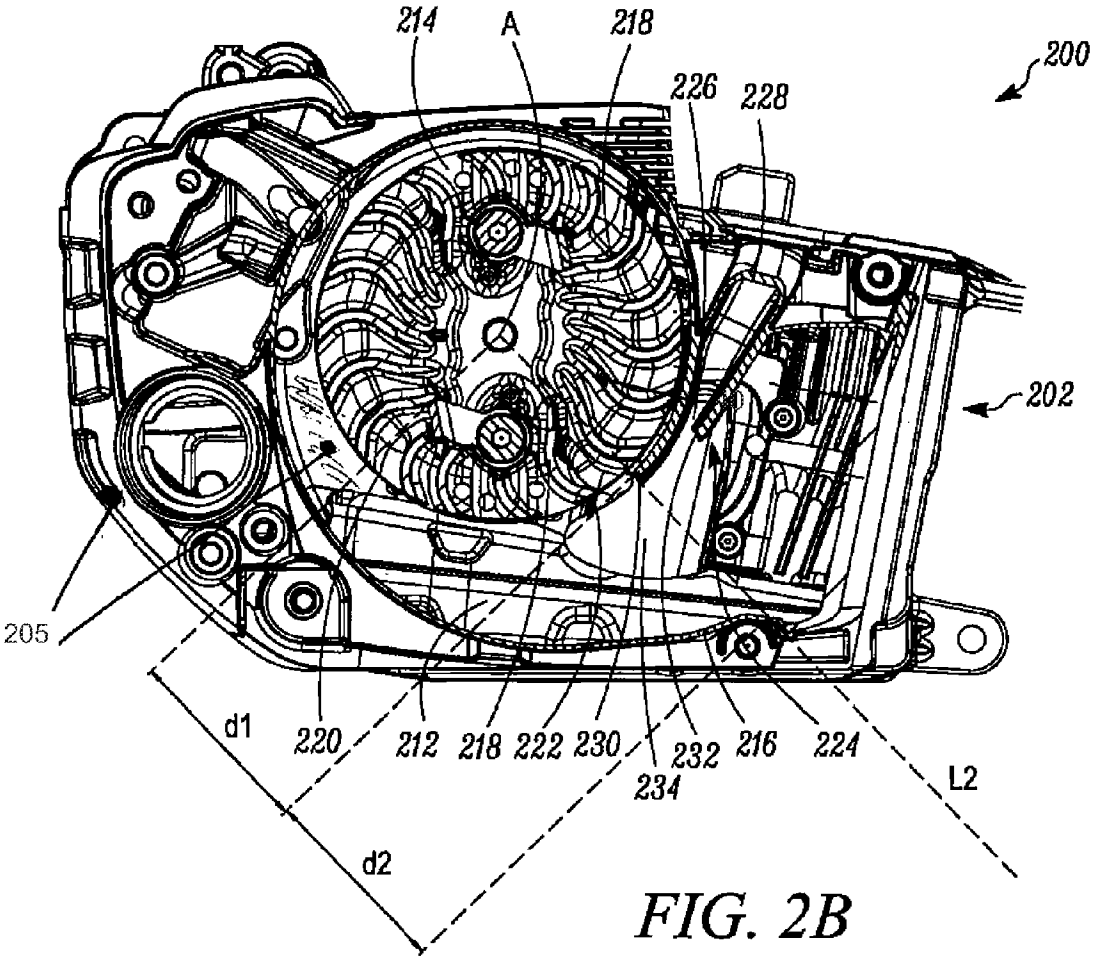
FIG. 2B illustrates a partial side view of the engine housing, according to another embodiment of the present invention.

FIG. 2B illustrates a partial side view of the engine housing 200, according to another embodiment of the present invention. As illustrated in FIG. 2B, the first edge 230 is located at a radial distance d1 from the axis A. The radial distance d1 is substantially along the radius L2. In an embodiment of the present invention, a distance d2 between the first edge 230 and the fan housing 216 along the radius L2 is at least 0.65 d1, preferably at least 0.7 d1, and even more preferably at least 0.75 d1. In another embodiment of the present invention, the distance d2 is at least 0.8 d1, preferably at least 0.85 d1, and even more preferably at least 0.9 d1. These conditions for d2 imply that the cross-sectional area of the cooling air flow is great at the position of the combustion air inlet in comparison to prior art solutions. Thus, the cooling air flow will not be very much affected by the combustion air inlet. This has proved very beneficial to the cooling capacity.

Moreover, in an embodiment of the present invention, as illustrated in FIGS. 2A and 2B, a shield portion 234 is arranged in close proximity to the combustion air inlet port 226. The shield portion 234 is preferably flat, but not necessarily, and extends an angular distance of at least about 5°, preferably at least about 10°, and even more preferably at least about 15° with respect to the axis A. Further, the angular distance may be at least 20°, 25° or 30°. In an embodiment of the present invention, at least one diverting portion 235 (see especially FIG. 4 or FIG. 5), of the shield portion 234 diverts from a planar surface. The shield portion 234 at least partially prevent particles in the separated air flow that bounce against the cylinder 204 (or against other parts within the fan housing or elsewhere) from ending up in the combustion air inlet 224. Protecting the combustion air inlet 224 from such bouncing particles has proved to be an efficient way of improving the purification of the combustion air. In an embodiment of the present invention, the shield portion 234 and the combustion air inlet 224 form one single unit. Of course, numerous of different configurations of the shield portion 234 are possible. Preferably, the shield portion 234 partially encloses an air flow upstream of the combustion air inlet 224. Preferably, at least a part or a major part of the shield portion 234 is parallel to a plane perpendicular to the axis A.

Figure 3:
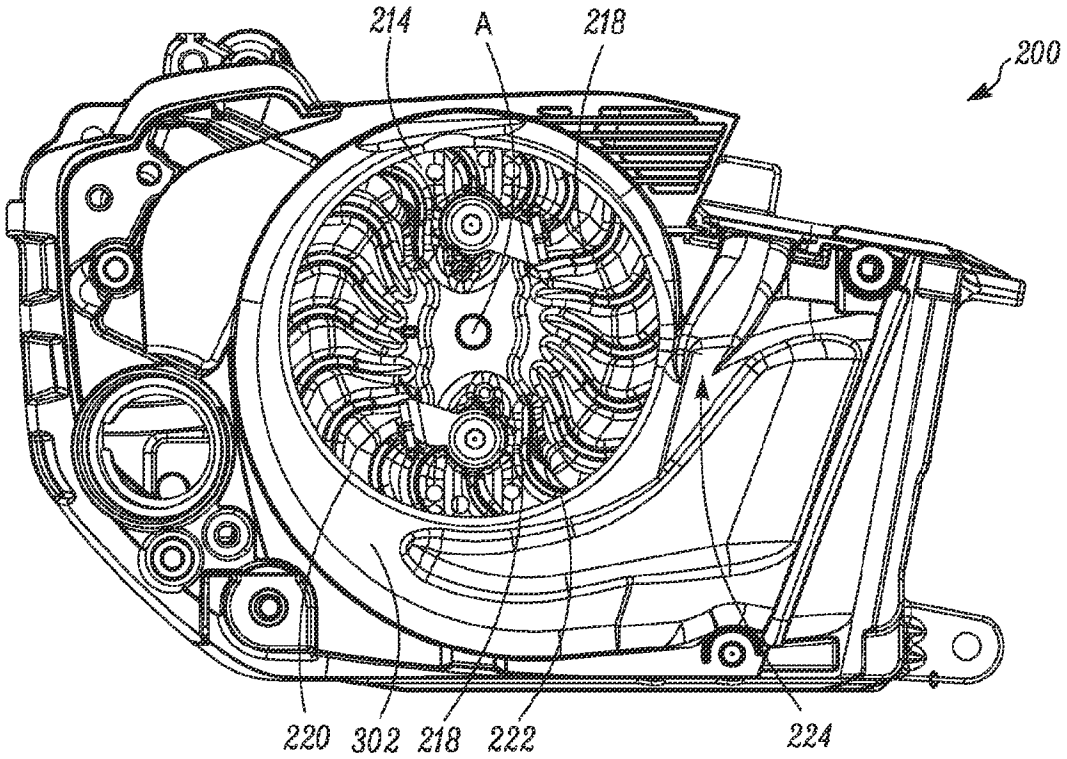
FIG. 3 illustrates a side view of the engine housing, according to an embodiment of the present invention.

FIG. 3 illustrates a side view of the engine housing 200, according to an embodiment of the present invention. As illustrated in FIG. 3, a fan housing cover 302 is arranged over the fan housing 216. In an embodiment of the present invention, the fan housing cover 302 forms a part of the fan housing 216. Further, at least a part of the combustion air inlet 224 and the fan housing cover 302 form a single unit.

A deflector 304 is located radially outside and in close proximity to the periphery 220 of the fan wheel 214. The deflector 304 is configured to direct a flow of air and particles blown out of the fan wheel 214 away from the fan wheel, such as, but not limited to, radially outwardly, and thereby at least preventing air and possibly particles from re-circulating with the fan wheel 214. In an embodiment of the present invention, the deflector 304 may be part of the fan housing cover 302 (see FIGS. 4 and 5).

With reference to FIGS. 2A, 2B and 3, during operation of the chainsaw 100, the fan wheel 214 rotates in order to draw in ambient air through the multiple intake openings 108 provided in the side cover 106. However, it is apparent through a person ordinarily skilled in the art that air may enter through any other openings located on the body 102. Ambient air can include particulate impurities, for example, but not limited to, sawdust, dirt, debris, or the like. Rotation of the fan wheel 214 induces a substantially centrifugal purification to ambient air. Due to centrifugal force, a flow with high particle density may be separated from a flow with low particle density. Moreover, a configuration of the combustion air inlet 224 and the deflector 304 as one single unit ensures that a flow with low particle density may enter the combustion air inlet port 226 as combustion air whereas a flow with high particle density may be used to cool the cylinder 204. In fact, the combustion air inlet 224 and the deflector 304 forming one single unit has proved very beneficial, since, which is evident from the foregoing, this one unit then performs at least two tasks, such as, separating the combustion air flow from the cooling air flow, and directing flow away from the fan wheel. The deflector can also be so designed as to direct the flow of cooling air towards e.g. the cylinder (and/or towards other parts of the engine that need cooling) of the internal combustion engine.

In an embodiment of the present invention, this type of arrangement of the combustion air inlet 224 and the deflector 304 is especially suitable for a lying cylinder configuration.

Figure 4:
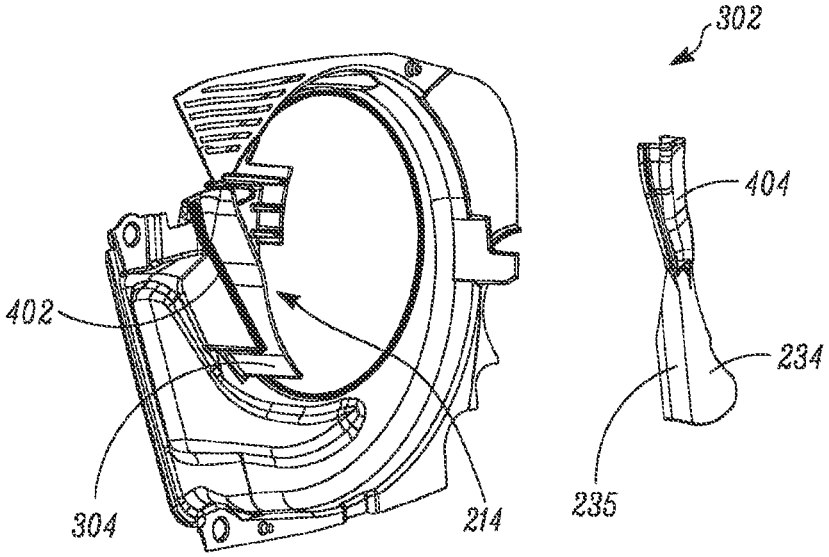
FIG. 4 illustrates various components of a fan housing cover, according to an embodiment of the present invention.

FIG. 4 illustrates various components of the fan housing cover 302, according to an embodiment of the present invention. As illustrated in FIG. 4, the fan housing cover 302 includes a first part 402 and a second part 404 of the combustion air inlet 224. In an embodiment of the present invention, the shield portion 234 is integral with the second part 404. However, in various other embodiments of the present invention, the shield portion 234 is integral with the first part 402 of the combustion air inlet 224 or is a separate component. It is apparent to a person ordinarily skilled in the art that the fan housing cover 302 may have any other monolithic or modular construction within the scope of the present invention. Further, the second part 404 is attached to the first part 402 by various processes, for example, but not limited to, welding, brazing, gluing, or the like. Such a configuration of the fan housing cover 302 simplifies the manufacturing process and results in a more compact construction with reduced number of parts.

Figure 5:
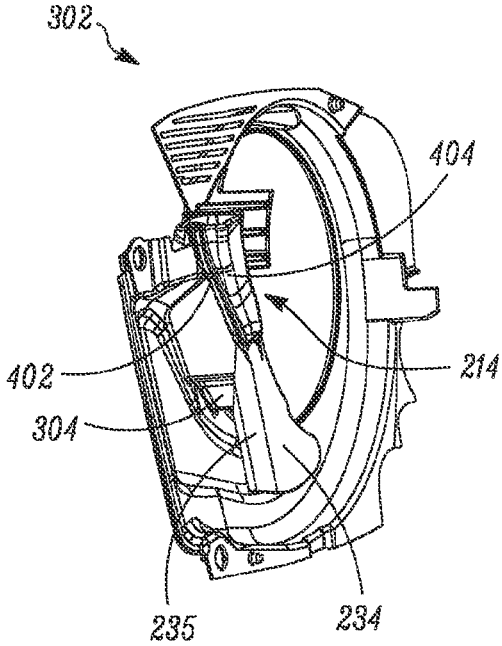
FIG. 5 illustrates an integrated fan housing cover, according to an embodiment of the present invention.

FIG. 5 illustrates an integrated fan housing cover 302, according to an embodiment of the present invention. As illustrated in FIG. 5, the fan housing cover 302 includes the combustion air inlet 224, the deflector 304 and the shield portion 234. Having all these components integrated in the fan housing cover 302, simplifies the manufacturing process and probably shortens the assembly time. In an embodiment of the present invention, one or more components of the fan housing cover 302 are made of plastic. However, it is apparent to a person ordinarily skilled in the art that one or more components of the fan housing cover 302 may be made of any other suitable material, for example, but not limited to, metal, composite, or the like.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A hand-held work apparatus, comprising:

an engine housing;

an internal combustion engine arranged in the engine housing and comprising a cylinder and a crankshaft;

a fan wheel driven directly or indirectly by the crankshaft, such that the fan wheel rotates about an axis (A);

a fan housing surrounding and cooperating with the fan wheel;

a combustion air inlet located radially outside of the fan wheel for leading air to the internal combustion engine, the combustion air inlet comprises a combustion air inlet port and a combustion air duct; and the combustion air inlet port is provided with a first edge, wherein the first edge is located radially adjacent to a periphery of the fan wheel, wherein an angle (X) between a first line (L1), extending radially from the axis (A) in a direction parallel to a main direction of the cylinder, and a radius (L2), extending radially from the axis A in a direction such that it intersects with the first edge, is less than 70°, wherein a deflector located radially outside and in close proximity to the periphery of the fan wheel directs the flow of air blown out of the fan wheel away from the fan wheel, so as to at least prevent the air from continuing to circulate with the fan wheel.

2. A hand-held work apparatus according to claim 1, wherein the angle (X) is less than 58°.

3. A hand-held work apparatus according to claim 2, wherein the angle (X) is less than 46°.

4. A hand-held work apparatus according to claim 1, wherein the combustion air inlet forms one single unit with the deflector, which unit enables separation of the air flow in the fan housing such that a flow with low particle density is enabled to be conducted into the combustion air inlet port and a flow with higher particle density is enabled to be used for cooling at least the cylinder of the internal combustion engine.

5. A hand-held work apparatus according to claim 1, wherein the internal combustion engine is provided with a muffler and a portion of the muffler housing forms a part of the fan housing.

6. A hand-held work apparatus according to claim 1, wherein the hand-held work apparatus is a chainsaw with a lying cylinder configuration.

7. A hand-held work apparatus according to claim 1, wherein the first edge is disposed at a radial distance (d1) from the axis (A) along the radius (L2), and, a distance (d2) between the first edge and the fan housing along the radius (L2) is at least 0.65(d1).

8. A hand-held work apparatus, comprising:

an engine housing;

an internal combustion engine arranged in the engine housing and comprising a cylinder and a crankshaft;

a fan wheel driven directly or indirectly by the crankshaft, such that the fan wheel rotates about an axis (A);

a fan housing surrounding and cooperating with the fan wheel;

a combustion air inlet located radially outside of the fan wheel for leadin~ air to the internal combustion engine, the combustion air inlet comprises a combustion air inlet port and a combustion air duct; and the combustion air inlet port is provided with a first edge, wherein the first edge is located radially adjacent to a periphery of the fan wheel, wherein an angle (X) between a first line (L1), extending radially from the axis (A) in a direction parallel to a main direction of the cylinder, and a radius (L2), extending radially from the axis (A) in a direction such that it intersects with the first edge, is less than 70°, wherein a fan housing cover forms a part of the fan housing and at least a part of the combustion air inlet forms one unit with the fan housing cover, and wherein the combustion engine comprises a crankcase and a part of the combustion air inlet is formed in said crankcase.

9. A hand-held work apparatus according to claim 8, wherein the fan housing cover and the combustion air inlet are made of a plastic material and the combustion air inlet is formed by joining at least two parts by welding or gluing.

10. A hand-held work apparatus, comprising:

an engine housing;

an internal combustion engine arranged in the engine housing and comprising a cylinder and a crankshaft;

a fan wheel driven directly or indirectly by the crankshaft, such that the fan wheel rotates about an axis (A);

a fan housing surrounding and cooperating with the fan wheel;

a combustion air inlet located radially outside of the fan wheel for leading air to the internal combustion engine, the combustion air inlet comprises a combustion air inlet port and a combustion air duct; and the combustion air inlet port is provided with a first edge, wherein the first edge is located radially adjacent to a periphery of the fan wheel, wherein an angle (X) between a first line (L1), extending radially from the axis (A) in a direction parallel to a main direction of the cylinder, and a radius (L2), extending radially from the axis (A) in a direction such that it intersects with the first edge, is less than 70°, and wherein the combustion air inlet port is provided with a second edge, disposed downstream and radially outside of the first edge in relation to the fan wheel, and the second edge is disposed on the same side as the fan wheel of a tangent (T), which is defined as the tangent of the periphery of the fan wheel which intersects with the first edge.

11. A hand-held work apparatus according to claim 10, wherein the fan wheel comprises fins and at least some of the fins, each has an outer edge at the periphery of the fan wheel, wherein at least one of the first and the second edges deviates at least 5° from being parallel to the outer edge of at least one of said fins.

12. A hand-held work apparatus, comprising:

an engine housing;

an internal combustion engine arranged in the engine housing and comprising a cylinder and a crankshaft;

a fan wheel driven directly or indirectly by the crankshaft, such that the fan wheel rotates about an axis (A);

a fan housing surrounding and cooperating with the fan wheel;

a combustion air inlet located radially outside of the fan wheel for leading air to the internal combustion engine, the combustion air inlet comprises a combustion air inlet port and a combustion air duct; and the combustion air inlet port is provided with a first edge, wherein the first edge is located radially adjacent to a periphery of the fan wheel, wherein an angle (X) between a first line (L1), extending radially from the axis (A) in a direction parallel to a main direction of the cylinder, and a radius (L2), extending radially from the axis (A) in a direction such that it intersects with the first edge, is less than 70°, and wherein a shield portion is arranged in the close proximity to the combustion air inlet port and spans an angle (Y) defined by two lines which extend radially from the axis (A) in a direction such that they intersect with a first edge and second edge of the shield portion, respectively, and wherein the angle (Y) is at least 5°.

13. A hand-held work apparatus according to claim 12, wherein at least a portion of the shield portion deviates from a plane surface.

14. A hand-held work apparatus according to claim 12, wherein the shield portion forms one unit with the combustion air inlet.

15. A hand-held work apparatus, comprising:

an engine housing;

an internal combustion engine arranged in the engine housing and comprising a cylinder and a crankshaft;

a fan wheel driven by the crankshaft, such that the fan wheel rotates about an axis (A);

a fan housing surrounding and cooperating with the fan wheel;

a combustion air inlet located radially outside and in close proximity to a periphery of the fan wheel for leading air to the internal combustion engine, the combustion air inlet comprises a combustion air inlet port and a combustion air duct;

a deflector located radially outside and in close proximity to the periphery of the fan wheel which directs the flow of air blown out of the fan wheel away from the fan wheel, so as to at least prevent the air from continuing to circulate with the fan wheel, wherein the combustion air inlet forms one single unit with the deflector, which unit separates the flow such that a flow with low particle density is enabled to be conducted into the combustion air inlet, and a flow with higher particle density is enabled to be used for cooling at least the cylinder of the internal combustion engine, wherein the combustion air inlet port is provided with a first edge, wherein the first edge is located radially adjacent to the periphery of the fan wheel, and, an angle (X) between a first line (L1), extending radially from the axis (A) in a direction parallel to a main direction of the cylinder, and a radius (L2), extending radially from the axis (A) in a direction such that it intersects with the first edge, is less than 70°.

16. A hand-held work apparatus, comprising:

an engine housing; an internal combustion engine arranged in the engine housing and comprising a cylinder and a crankshaft;

a fan wheel driven directly or indirectly by the crankshaft, such that the fan wheel rotates about an axis (A);

a fan housing surrounding and cooperating with the fan wheel;

a combustion air inlet located radially outside of the fan wheel for leading air to the internal combustion engine, the combustion air inlet comprises a combustion air inlet port and a combustion air duct; and the combustion air inlet port is provided with a first edge, wherein the first edge is located radially adjacent to a periphery of the fan wheel, and the first edge is disposed at a radial distance d1 from the axis (A) along a radius (L2) extending in a radial direction of the fan wheel, which radius (L2) intersects with the axis (A) and the first edge, wherein a distance (d2) between the first edge and the fan housing along the radius (L2) is at least 0.65(d1).

17. A hand-held work apparatus according to claim 16, wherein the distance (d2) is at least 0.8(d1).

* * * * *

UNITED STATES PATENT AND TRADEMARK OFFICE

CERTIFICATE OF CORRECTION

PATENT NO. : 8,844,477 B2
APPLICATION NO. : 13/512159
DATED : September 30, 2014
INVENTOR(S) : Stefan Stark et al.

It is certified that error appears in the above-identified patent and that said Letters Patent is hereby corrected as shown below:

In the Claims

Column 10, Claim No. 8, Line 37 "wheel for leadin~ air to the internal combustion engine," should read --wheel for leading air to the internal combustion engine,--.

Signed and Sealed this
Seventeenth Day of February, 2015

Michelle K. Lee

Michelle K. Lee
*Deputy Director of the United States Patent and Trademark Office*